United States Patent [19]

Ström

[11] 4,019,421

[45] Apr. 26, 1977

[54] ARRANGEMENT FOR SELECTIVE FIRING OF SO-CALLED IR-TORCHES

[75] Inventor: Johan Paul Ström, Jarfalla, Sweden

[73] Assignee: U.S. Philips Corporation, New York, N.Y.

[22] Filed: Nov. 19, 1975

[21] Appl. No.: 633,282

[30] Foreign Application Priority Data

Nov. 22, 1974 Sweden ..... 7414669

[52] U.S. Cl. ..... 89/1.5 R; 339/8 R

[51] Int. Cl.[2] ..... F41F 5/02

[58] Field of Search ..... 89/1.5 R, 1.5 D; 102/37.7, 37.8; 244/3.16; 339/8 R, 255 R

[56] References Cited

UNITED STATES PATENTS

| | | | |
|---|---|---|---|
| 2,757,351 | 7/1956 | Klostermann | 339/255 R |
| 2,778,275 | 1/1957 | Wells | 89/1.5 R |
| 2,820,397 | 1/1958 | Durkin | 89/1.5 R |
| 3,150,848 | 9/1964 | Lager | 244/3.16 |
| 3,438,123 | 4/1969 | Buschbom | 339/8 R X |
| 3,439,307 | 4/1969 | Ruscher | 339/8 R |
| 3,808,940 | 5/1974 | Schillreff et al. | 89/1.5 R X |
| 3,808,941 | 5/1974 | Biggs | 89/1.5 R |
| 3,841,219 | 10/1974 | Schillreff | 102/37.8 X |

*Primary Examiner*—David H. Brown
*Attorney, Agent, or Firm*—Frank R. Trifari

[57] ABSTRACT

Arrangement for selective firing of IR-torches comprising an interchangeable magazine having cartridges each of which holds a predetermined number of the torches. The cartridges are positioned in corresponding tubular frames of the magazine. A mounting ramp is provided with a central guiding pin and a polar guiding pin to be fitted into corresponding recesses of the magazine when mounting the same. Each cartridge is provided with electric connecting means in the shape of concentric contact rings, the number of which is at least one more than the number of torches of the cartridge. The rings are provided on a plate at the end of the cartridge and are put into electric contact with corresponding point-shaped contact elements of the ramp during mounting of the magazine onto the ramp.

9 Claims, 5 Drawing Figures

ARRANGEMENT FOR SELECTIVE FIRING OF SO-CALLED IR-TORCHES

The invention is directed to an arrangement for selective firing of so-called IR-torches. The arrangement comprises a firing ramp shaped so as to support an interchangeable magazine having cartridges each of which comprises a predetermined number of said IR-torches, in which during mounting of the magazine onto the ramp electric connecting means provided on each of the cartridges are put into contact with corresponding electric connection pieces provided on the ramp so that the cartridges may be supplied separately with electric firing control signals via said ramp. The ramp is provided with a central guiding and polar guiding pin intended to be fitted into corresponding control recesses of the magazine during mounting in a manner such that the magazine will have a well defined axial position and angular position, respectively, with respect to the ramp, and in which the interior of each magazine is provided with tubular frames extending in parallel with the central axis of the magazine and in which the likewise tubular cartridges are inserted.

Arrangements of the type described are previously known and are commonly used on aeroplanes as a counter measure in order to prevent or complicate detection of the aeroplane by sensing the IR-radiation it transmits. By firing IR-torches of this type it is possible, for example, to divert homing missiles using the IR-radiation for target identification.

When used on an aeroplane said ramp is ordinarily provided beneath a wing of the aeroplane. Firing the IR-torches is initiated by control signals transmitted from the pilot's cockpit via said ramp to the actual cartridge and the IR-torches provided therein.

Arrangements of the actual type must fulfil very stringent requirements with respect to reliability and simple maintenance. Since a magazine of the known type may have a weight which is relatively high and since the magazines are interchanged manually, the mounting of the same should be as simple as possible and at the same time every possibility to obtain a decreased weight should be utilized without decreasing the reliability.

An arrangement is previously known in which there is used a contact means of the plug type for obtaining electric connection between ramp and cartridge, and in which the receptacle contact may be provided on the ramp and the corresponding contact pin may be provided on the cartridge. This solution, however, has essential drawbacks, which are due to the fact that when using contacts of this type, besides an adequate axial positioning of the magazine which is relatively simple, also an accurate polar positioning of each of the cartridges in the magazine is required, which means that manufacturing cost is substantially increased. In practice, since smaller deviations from such an accurate orientation may not be avoided the mechanical stress on said contact pieces will be substantial, which will complicate severely the mounting of the magazine onto the ramp and which may also bring with it contact errors after a number of magazine changes. Furthermore, said contacts will give a contribution to the weight of the magazine which may not be neglected.

Said drawbacks are eliminated in an arrangement which, according to the invention, is characterized in that the electric connection means provided on each of said cartridges is composed of a plate of an adequate electrically insulating material on which a number of separate electrically conductive contact rings are provided concentrically with respect to the central axis of the cartridge. The innermost contact ring may be shaped as a circular contact point. The number of contact rings is at least one more than the number of torches in each cartridge, while said plate is positioned on that end of the cartridge which is directed towards the ramp and in such a manner that it is substantially perpendicular to the central axis of the cartridge. The corresponding connection pieces of the ramp for each cartridge comprises at least the same number of point-shaped electric contact elements as the number of contact rings, said elements being so arranged that each of the point-shaped contact elements is brought into electric contacts with its appertaining contact ring on said plate when the magazine is mounted mechanically.

Because of the contact pieces used in this arrangement, the requirement with respect to an accurate polar positioning of the cartridges in the magazine is eliminated totally and at the same time there is achieved a cheap and technically simple solution to the actual contacting problem. The contact elements of the invention will provide a negligible contribution to the weight of the magazine and may be used repeatedly with a maintained high reliability.

By shaping the contact elements according to the invention, the advantage is achieved of a magazine having no electric connections on the magazine itself which contributes to further simplify the assembling of cartridges and magazine and makes easier the handling during the mounting operation.

According to one preferred embodiment of the arrangement according to the invention the point-shaped contact elements are shaped as a spring-loaded and displaceable contact pin, while said plate having the contact rings is shaped as a printed circuit.

The invention will be described in more detail in the following description in connection with a preferred embodiment and with reference to the accompanying drawings, in which.

Figure 1:
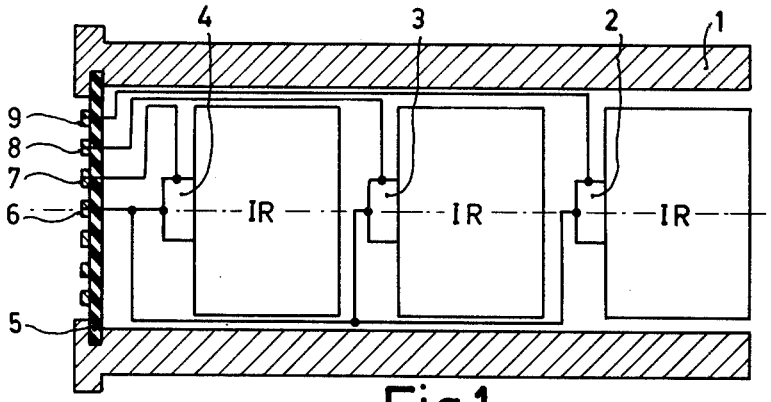
FIG. 1 shows a longitudinal section of a cartridge having three successively arranged IR-torches.

FIG. 1 shows schematically a longitudinal section of a cartridge 1 having three successively arranged IR-torches designated IR. At each of said torches are arranged a firing charge means 2, 3 and 4, respectively, which may be initiated electrically. For each of the charge means there is provided two electric lines from the plate 5, i.e. one line from the appertaining contact ring 7, 8 and 9, respectively, and one line from the central contact point 6, which is used in common by all the charge means.

Figure 2:
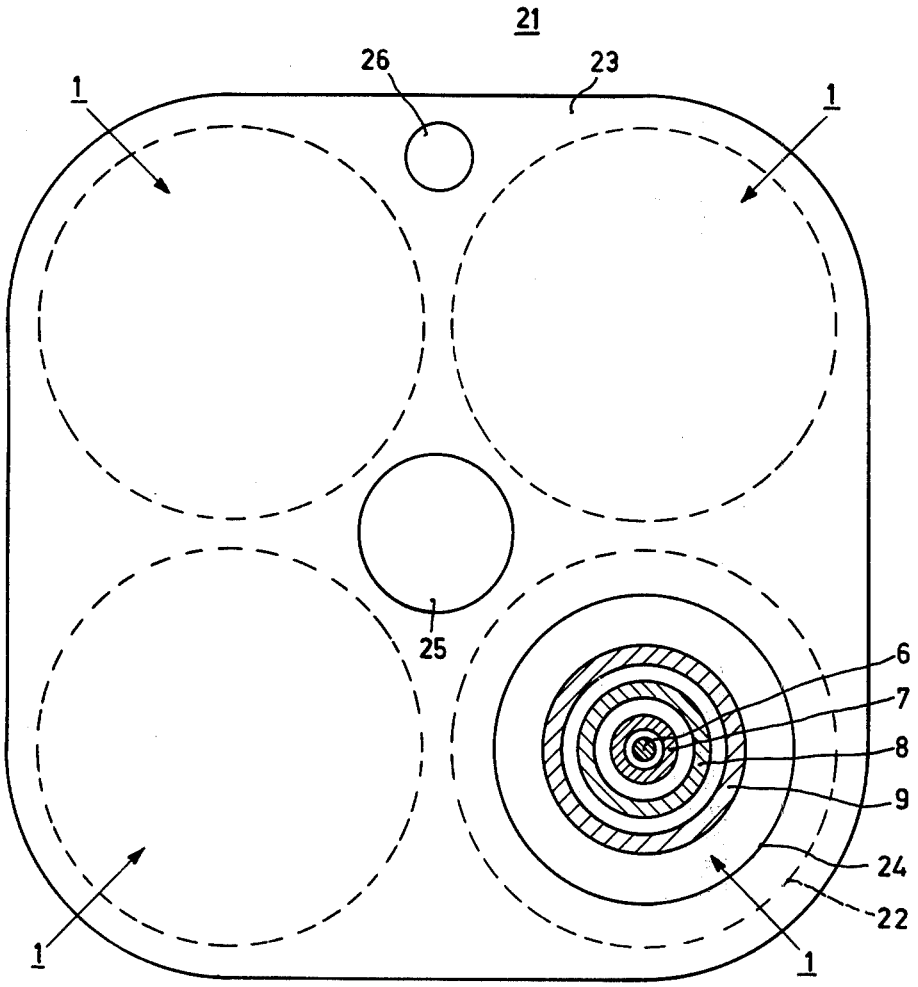
FIG. 2 shows the magazine and the cartridges provided therein in a view of the end which is directed to the ramp.

In FIG. 2 is shown a magazine 21 in a view from the end which is directed to the ramp. The external diameter of the tubular frames 22 provided in the magazine is denoted by dotted lines, and a disc 23 is provided at the end of the magazine in order to lock the cartridges into the frames 22. The disc 23 is provided with circular openings 24 provided opposite to the respective frames. Via said openings 24 the plates 5 of the respective cartridges, each having the contact rings 6, 7, 8 and 9, are accessible. The central guide is provided by a cylindrical recess 25 intended to be threaded onto an axial pin of the ramp, while the bore 26 is intended to be threaded onto said polar guiding pin.

Figure 3:
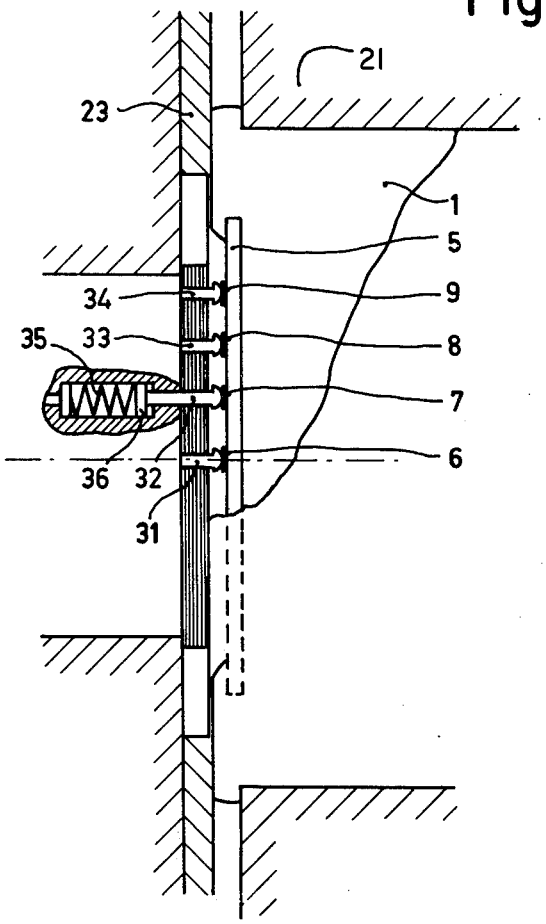
FIG. 3 shows more clearly the electric connection between a cartridge and a corresponding section of the ramp.

In FIG. 3 there is disclosed more clearly the electric connection between the plate 5 of cartridge 1 and the contact rings 6, 7, 8 and 9 provided thereon. When the cartridge is in the mounted position shown, the contact rings will be in contact with a respective contact pin 31, 32, 33 and 34 of which the contact pin 32 is shown in detail. The pin 32 is spring-loaded by means of a coil spring 35 and is provided with a threshold 36, which when no magazine is mounted on the ramp will be in contact with the corresponding threshold of the recess provided in the ramp for the pin 32. Said thresholds are then so shaped that the pin is pushed inwards when mounting the magazine so that the compression of the spring 35 will provide an adequate contact pressure between the pin 32 and the corresponding contact ring 7.

Figure 4A:
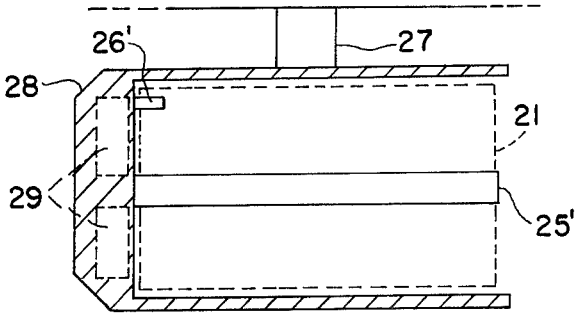
FIGS. 4*a* and 4*b* show a longitudinal section and an end view of a firing ramp with the magazine inserted therein.
Figure 4B:
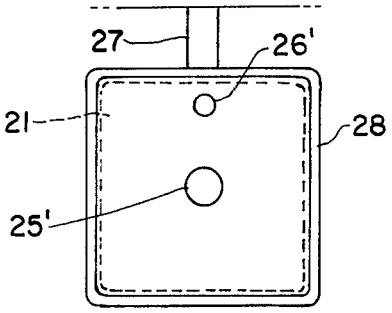

FIGS. 4*a* and 4*b* show a longitudinal section and an end view, respectively, of a firing ramp 28 with the magazine 21 indicated therein. The ramp is attached to an aeroplane (not shown) by a member 27. Electric connection members 29 are represented at the left end of ramp 28 by means of which the firing control signals may be supplied to the contact rings (6–9 in FIG. 2) of a cartridge. The connection members 29 were described in detail with reference to FIG. 3. FIGS. 4*a* and 4*b* also show an axial guide pin 25' and a polar guide pin 26' which are dimensioned and arranged so that they closely fit into the corresponding recess 25 and bore 26 of magazine 21 (see FIG. 2).

In order to improved further the reliability and to eliminate every influence by electric voltages which may appear when the magazine is mounted, the contact pin, which is intended when mounting the magazine to be brought into contact with the contact point which is common to all torches of a cartridge and constituting a connection to ground (pin 31 and ring 6 of FIG. 3), may be so shaped that in its rest position it will protrude from the ramp further than the other contact pins. Thus it is achieved that the connection to ground is closed first when mounting the magazine.

What is claimed is:

1. Apparatus for selectively firing IR-torches comprising, a firing ramp shaped so as to support an interchangeable magazine holding a plurality of tubular cartridges each of which comprises a predetermined number of said IR-torches, each cartridge being provided with electric connecting means which, during mounting of the magazine onto the ramp, are put into contact with corresponding electric connection pieces providing on the ramp so that the cartridges may be supplied separately with electric firing control signals via said ramp, the ramp being provided with a central guiding pin and a polar guiding pin intended to be fitted into corresponding control recesses of the magazine during mounting and in a manner such that the magazine will have a well defined axial position and angular position, respectively, with respect to the ramp, the interior of each magazine being provided with tubular frames extending in parallel with the central axis of the magazine and in which frames the tubular cartridges are inserted, the electric connection means provided on each of said cartridges comprising a plate made of an adequate electrically insulating material on which a number of separate electrically conducting contact rings are provided concentrically with respect to the central axis of the cartridge, the number of contact rings being at least one more than the number of IR torches of each cartridge, said plate being positioned on that end of the cartridge which is directed to the ramp and in a manner such that it is substantially perpendicular to the central axis of the cartridge, said corresponding connection pieces of the ramp for each cartridge comprising at least the same number of point-shaped electric contact elements as the number of contact rings, said point-shaped contact elements being arranged so that each element is brought into electric contact with its corresponding contact ring on said plate when the magazine is mounted mechanically.

2. An apparatus according to claim 1, characterized in that the magazine end which is directed towards the ramp is provided with a removable disc having a circular opening opposite to each of said cartridges, the centre of said opening being coincident with the central axis of the cartridge and the opening having a diameter which is somewhat larger than the largest diameter contact ring whereby the contact rings are accessible to said point-shaped contact elements via the openings so provided, said disc being shaped so as to mechanically lock at the same time each cartridge in its respective frame.

3. An apparatus according to claim 1 wherein each of said point-shaped contact elements is composed of a spring-loaded contact pin displaceable in a direction parallel to the axis of said central guiding pin and which is arranged so as to protrude a predetermined distance from the ramp, whereby a well defined contact pressure between each of said contact pins and the corresponding contact rings is obtained when the magazine is brought into contact with the ramp during a mounting operation.

4. An apparatus according to claim 1 wherein one of said contact rings of each plate is arranged so as to provide a common connection to ground for each torch of its cartridge, the contact pin corresponding thereto being arranged so as to protrude a greater distance from the ramp than the further contact pins of the ramp.

5. An apparatus according to claim 1, characterized in that said plate and the contact rings provided thereon are formed as a printed circuit.

6. An apparatus as claimed in claim 1 wherein the innermost contact ring of said number of concentric contact rings is shaped as a circular contact point.

7. A magazine adapted to be interchangeably mounted in a firing ramp of an aircraft or the like comprising, a plurality of tubular frames situated within the magazine and extending parallel to the longitudinal axis of the magazine, a plurality of tubular cartridges insertable in said tubular frames with each cartridge holding a plurality of IR-torches adapted to be selectively fired in response to electric firing control signals received via a plurality of electric contact elements provided on said firing ramp, said magazine including first and second recesses adapted to mate with a respective central guiding pin and a polar guiding pin extending from the firing ramp so that the magazine will have a predetermined axial position and angular position relative to the firing ramp, each of said cartridges further comprising a plate made of an electric insulating material on which a plurality of individual electrically conductive contact rings are arranged concentrically about a central axis of the cartridge, the number of contact rings being at least one more than the number of IR-torches in said cartridge, said plate being located at the end of the cartridge which is to be directed towards the firing ramp and being arranged perpendicular to the central axis of the cartridge, said contact rings being arranged to be placed into contact with respective corresponding ones of said electric contact elements of the firing ramp when the magazine is mounted on the firing ramp.

8. A magazine as claimed in claim 7 wherein one end of the magazine is adapted to be directed towards the firing ramp and includes a removable disc having openings therein opposite to each of said cartridges with each opening being larger than the largest contact ring so that all of the contact rings are accessible to the ramp contact elements via said openings, said disc being formed so as to mechanically lock each cartridge in its respective frame.

9. In combination, a magazine as claimed in claim 7 and a firing ramp, wherein said firing ramp includes contact elements comprising spring-loaded elongate elements axially displaceable in a direction parallel to the axis of said central guiding pin, one of said contact rings being adapted to provide a common reference potential, and wherein the ramp contact element corresponding thereto is arranged to protrude further than the remaining contact elements so that said one contact ring and its corresponding contact element make contact before the remaining contact elements make contact with their respective contact rings upon mounting of the magazine to the firing ramp.

* * * * *

UNITED STATES PATENT AND TRADEMARK OFFICE

CERTIFICATE OF CORRECTION

PATENT NO. : 4,019,421

DATED : April 26, 1977

INVENTOR(S) : Johan Paul Ström

It is certified that error appears in the above-identified patent and that said Letters Patent are hereby corrected as shown below:

Col. 1, line 64, "give should be --provide--;

Col. 3, line 43, after "the" should be inserted

--contact ring or--.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*